United States Patent [19]

Focke

[11] Patent Number: 4,735,032

[45] Date of Patent: Apr. 5, 1988

[54] APPARATUS FOR CONVEYING CIGARETTE GROUPS

[75] Inventor: Heinz Focke, Verden, Fed. Rep. of Germany

[73] Assignee: Focke & Co. (GmbH & Co.), Verden, Fed. Rep. of Germany

[21] Appl. No.: 889,537

[22] Filed: Jul. 25, 1986

[30] Foreign Application Priority Data

Aug. 2, 1985 [DE] Fed. Rep. of Germany ..... 3527741

[51] Int. Cl.[4] ..... B65B 19/04; B65G 17/26

[52] U.S. Cl. ..... 53/149; 53/148; 53/154; 198/420; 198/792; 198/803.15; 198/853

[58] Field of Search ..... 53/148, 149, 153, 154, 53/236, 237; 198/420, 803.15, 838, 845, 853, 343, 419, 792

[56] References Cited

U.S. PATENT DOCUMENTS

| | | | |
|---|---|---|---|
| 1,466,451 | 8/1923 | Lev | 53/224 |
| 3,126,999 | 3/1964 | Motley | 198/419 |
| 3,279,145 | 10/1966 | Williamson | 53/236 |
| 3,448,846 | 6/1969 | Bardenhagen | 198/792 |
| 3,513,619 | 5/1970 | Kochalski et al. | 53/148 |
| 3,545,172 | 12/1970 | Osterdahl | 53/236 |
| 3,800,937 | 4/1974 | Tassie | 198/131 |
| 4,293,067 | 10/1981 | Anderson | 198/853 |
| 4,330,976 | 5/1982 | Blackall et al. | 53/151 |

FOREIGN PATENT DOCUMENTS

| | | |
|---|---|---|
| 2244533 | 4/1974 | Fed. Rep. of Germany . |
| 3116523 | 1/1982 | Fed. Rep. of Germany . |
| 2187611 | 1/1974 | France . |

*Primary Examiner*—Robert L. Spruill
*Assistant Examiner*—Donald R. Studebaker
*Attorney, Agent, or Firm*—Sughrue, Mion, Zinn, Macpeak & Seas

[57] ABSTRACT

For transporting cigarette groups (20) within or in conjunction with a packaging machine, a pocket conveyor (21) is used, and in this pockets (24), each receiving one cigarette group (20), are connected to one another so as to be free of play and free of wear by means of connecting joints (25) with rolling bearings. As a result, the pocket conveyor (21) can be used as a high-performance conveyor for cigarette groups with exact relative positions.

18 Claims, 12 Drawing Sheets

APPARATUS FOR CONVEYING CIGARETTE GROUPS

BACKGROUND OF THE INVENTION

The invention relates to an apparatus for conveying cigarette groups in conjunction with a packaging machine, each of the cigarette groups being received in a pocket of a driven (endless) conveyor.

The transport of cigarette groups, each corresponding to the content of a cigarette pack, in conjunction with their packaging presents a special problem in packaging technology. On the one hand, the cigarette groups should be conveyed in a predetermined formation, without the cigarettes being damaged. On the other hand, the conveying member should guarantee exact relative positions for pushing the cigarette groups into and out of pockets of the conveyor.

Pocket chains have proved basically suitable as effective high-performance conveyors for cigarette groups, in particular also because relatively long and also straight conveying distances can be mastered. A disadvantage is that pocket chains are not sufficiently accurate as regards the relative positions of the pockets, in comparison with a revolving turret as an alternative.

SUMMARY OF THE INVENTION

The object on which the invention is based is to improve the transport of cigarette groups by means of pockets, in such a way that, on the one hand, the flexibility of the transport paths is guaranteed in the same way as with a pocket chain, but on the other hand the relative positions of the pockets are guaranteed to be exact even after a lengthy period of operation.

To achieve this object, the apparatus according to the invention is characterized in that the pockets are connected to one another directly, to form a pocket conveyor, by means of connecting joints designed to be free of play and free of wear.

An essential disadvantage of the pocket chains used hitherto for transporting cigarette groups is that they undergo elongation as a result of tensile forces arising during operation and consequently make it impossible to obtain exact relative positions of the pockets in relation to other members of the packaging machine. This defect is eliminated by means of the pocket conveyor according to the invention, in which the individual pockets, each intended for receiving a cigarette group, are connected directly to one another in an articulated manner, so as to guarantee exact guidance and positioning of the pockets or pocket orifices for the cigarette groups.

According to a preferred exemplary embodiment, each pocket, on sides located opposite one another (the front wall and rear wall), is provided with at least one, but especially two (rigid) joint plates which are arranged at a distance from one another and which are mounted, together with offset joint plates of an adjacent pocket, on a common transversely directed joint axle (pivot pin) by means of ball bearings.

A pocket conveyor designed according to the invention is free of play and free of wear and can therefore be used as an equivalent conveying member for cigarette groups in addition to a revolving turret. The pocket conveyor makes it possible to have a plurality of complex conveying paths for the cigarette groups. In the invention, the endless pocket conveyor is guided via two deflecting rollers which can be moved to and fro (together) in a (horizontal) plane. It is thereby possible to drive individual conveyor portions of the pocket conveyor continuously, whilst at the same time driving other conveyor portions intermittently. In this case, the differences in movement are compensated by the deflecting rollers moved to and fro in a synchronized manner.

In the preferred practical example of the pocket conveyor according to the invention, during a standstill phase cigarette groups are pushed into several associated pockets simultaneously in the region of a horizontal conveyor strand, especially in the region of a lower strand. Another conveyor portion, especially an upper strand of the pocket conveyor, is assigned to a continuously moved member of the packaging machine, e.g. a continuously rotating folding turret. The upper strand of the pocket conveyor is brought up against the periphery of the folding turret, so that, during a synchronous continuous movement, the cigarette groups can be transferred from the pockets of the pocket conveyor onto the folding turret by axial displacement, in particular being introduced into pockets of the folding turret to be wrapped in an inner wrapper (tin foil blank).

The pockets are designed so that the pocket conveyor is guided both vertically and horizontally (against sagging and lateral movements), at least in part regions of the path of movement. Attached to the top side and/or underside of the pockets are toothed webs which serve on the one hand as a member for guiding the pocket conveyor and on the other hand for positive meshing with drive members, with the folding turret, etc.

BRIEF DESCRIPTION OF THE DRAWINGS

Exemplary embodiments of the invention are explained in detail below with reference to the drawings. In the drawings.

DETAILED DESCRIPTION OF THE PREFERRED EMBODIMENTS

Figure 1:
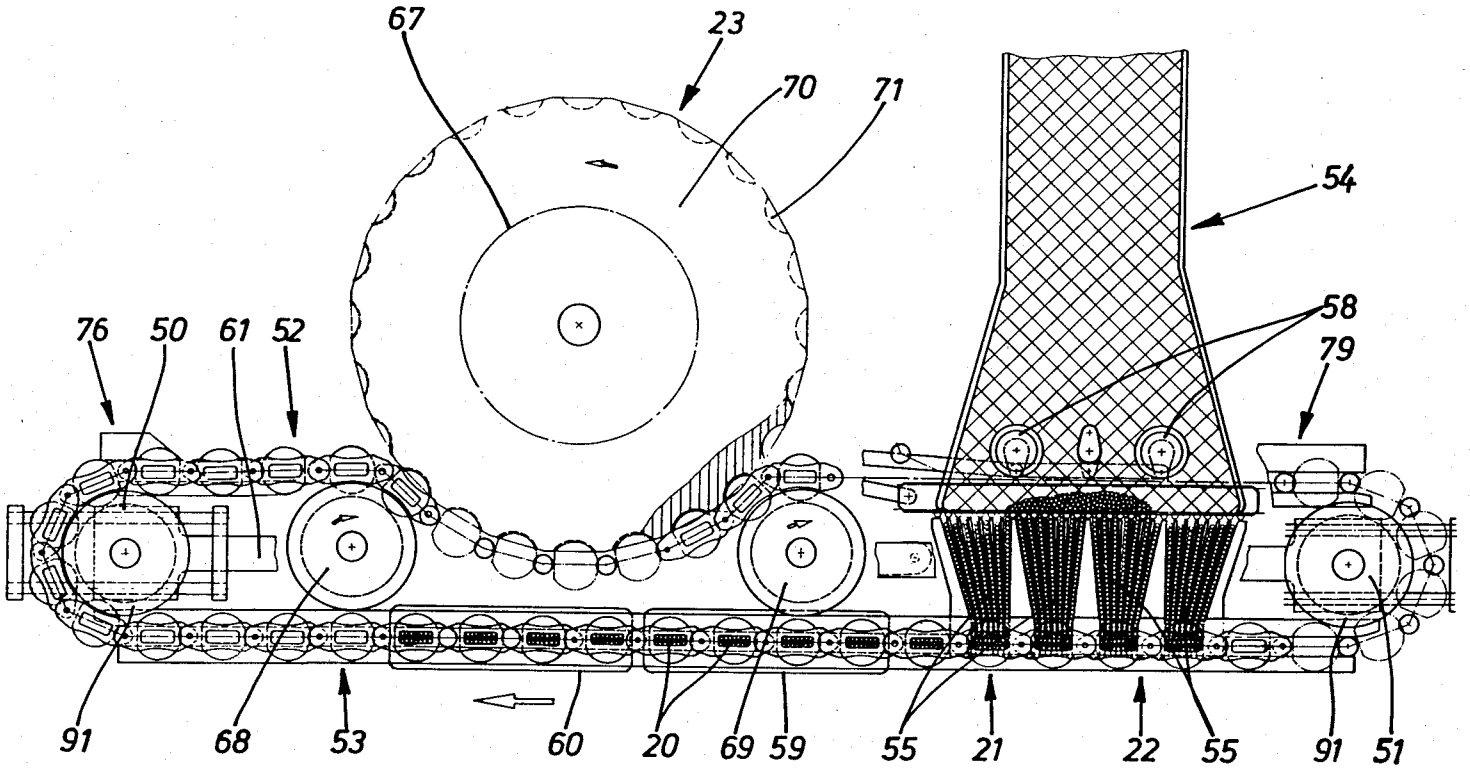
FIG. 1 shows a side view of an apparatus as part of a packaging machine, with a conveyor for cigarette groups.

The exemplary embodiments illustrated in the drawings relate to the transport of cigarette groups 20 in the region of or in conjunction with a cigarette packaging machine. In terms of the number and formation (relative positions) of the cigarettes, each cigarette group 20 corresponds to the content of a cigarette pack to be produced. The cigarette groups 20 are delivered, by means of a conveyor in the form of a pocket conveyor 21, from an insertion station 22 to a member of the packaging machine, i.e. a folding turret 23.

Figure 4:
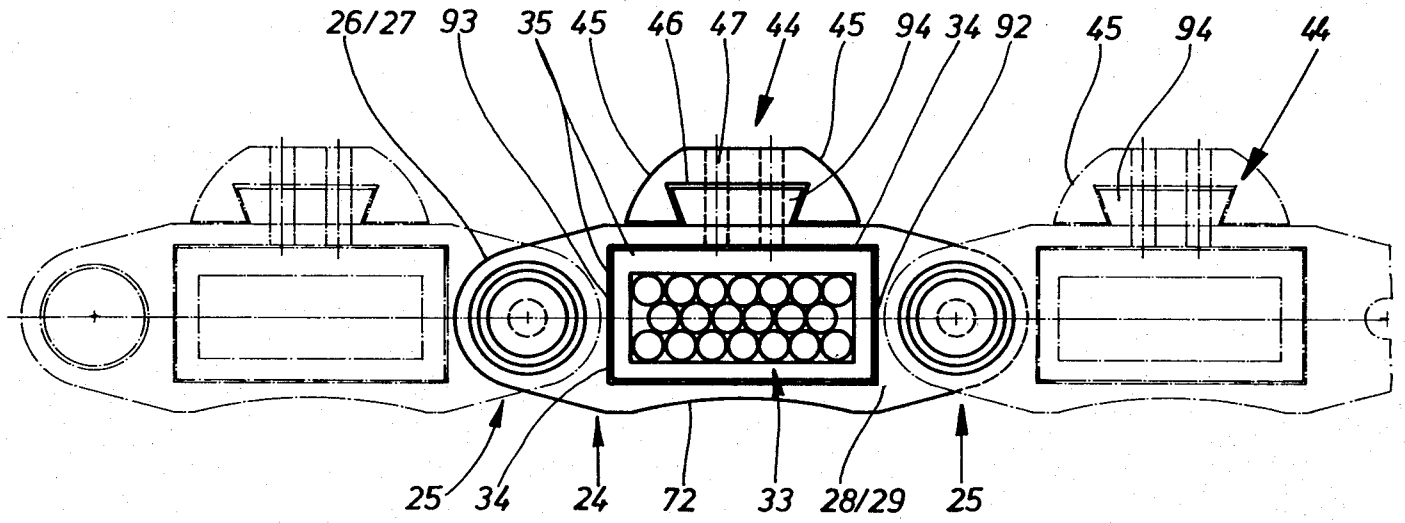
FIG. 4 shows a portion of a pocket conveyor in a side view on an enlarged scale.
Figure 5:
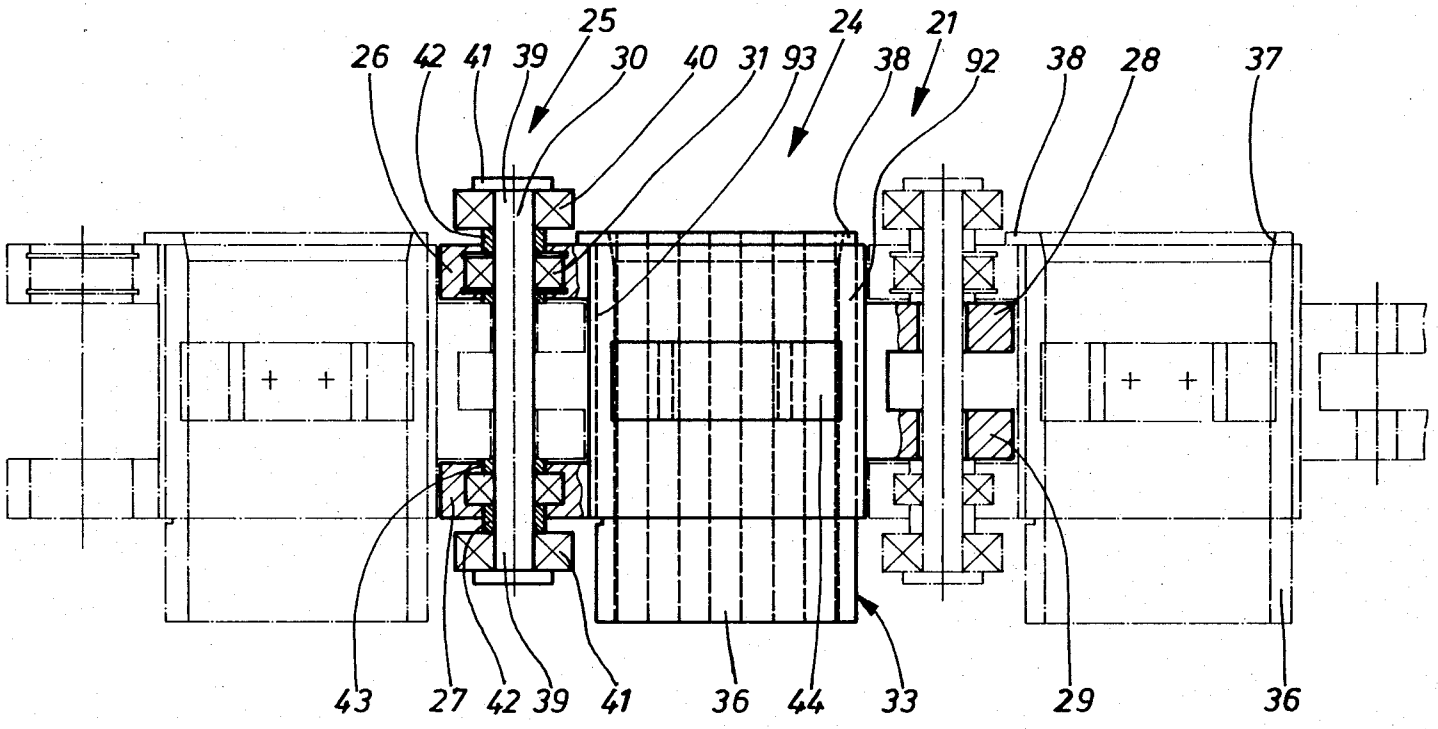
FIG. 5 shows a partially sectional plan view of the portion of the pocket conveyor according to FIG. 4.

The design of the (endless) pocket conveyor 21 is of primary importance. Pockets 24 consisting of dimensionally stable material, especially metal, are connected, at opposite ends or on opposite sides, to directly adjacent pockets 24 by means of connecting joints 25 designed to be free of wear and free of play. In the examplary embodiments illustrated, the connecting joints 25 are equipped with rolling bearings, in particular ball bearings. For this purpose, joint plates 26, 27 and 28, 29 which are rigid, in particular formed from the material of the pocket 24, are attached to each (front and rear) side of a pocket 24, i.e. to a front wall 92 and a rear wall 93. Two respective joint plates 26 to 29 of adjacent pockets 24 are mounted on a common joint axle, in the present case on a pivot pin 30 extending transversely. In the present exemplary embodiment according to FIGS. 4 and 5, two (outer) joint plates 26 and 27 are each mounted rotatably on the common pivot pin 30 by means of ball bearings 31. In the present case, the joint plates 28 and 29 extending between the joint plates 26 and 27 and assigned to the adjacent pocket are connected non-rotatably to the pivot pin 30. In the exemplary embodiment according to FIGS. 6 and 7, the inner joint plate 28 made especially wide is likewise fastened non-rotatably on the pivot pin 30. As a result of this design of the connecting joints 25, the pockets 24 can move easily relative to one another. There is no wear and consequently no elongation of the pocket conveyors 21 even after a lengthy period of operation.

Preferably, pocket orifices 32, each intended for receiving one cigarette group 20, are arranged centrally in the pockets 24, in particular symmetrically relative to the horizontal and vertical mid-plane. Accordingly, the pocket orifices 32 lie directly in the longitudinal plane of the pocket conveyor 21. This makes it possible to achieve a simple design of the pocket 24, with a small overall height.

In the exemplary embodiments illustrated, the pocket orifice 32 itself, in particular the cavity for receiving the cigarette group 20, is formed by a cassette 33 which can consist of a suitable material, even plastic. The cassette 33 has the internal dimensions of the pocket orifice 32, specifically matched to the particular size and shape of the cigarette group 20. The external dimensions of the cassette 33 are always the same, so that it can be inserted or pushed into a transversely directed recess 34 of the pockets 24 so as to fit in. When the format is changed, the cassette 33 is exchanged for another having the same external dimensions, but a different size or shape of the pocket orifice 32 as a result of a corresponding design of cassette walls 35. The cassettes 33 can also have differing axial dimensions, e.g. can project from the pocket 24 on one side by means of an extension 36, for the processing of particularly long cigarettes. A conical run-in mouthpiece 37 is formed on the push-in side of the cassettes 33 or pocket orifices 32. Here, moreover, the cassette 33 rests against the pocket 24 by means of a collar 38.

The pocket conveyor 21 can be supported, at least in part regions, against vertical movements, especially against sagging. For this purpose, the pivot pin 30, at one end or at both ends, is equipped with a supporting end 39 as a result of an appropriate extension. A guide roller 40 is arranged on each of these and is designed as a ball bearing and for providing support on corresponding guide tracks. End discs 41 are attached to the outer ends of the pivot pins 30 and prevent axial displacements of the pivot pin 30 or of the bearing parts. As is also evident, especially in FIG. 5, the guide rollers 40 are supported relative to the adjacent ball bearings 31 by means of spacer rings 42. Likewise, spacer rings 43 are arranged in the region between the ball bearings 31 of adjacent joint plates 26 . . . 29. A play-free mounting of the joint plates 26 . . . 29 on the common pivot pin 30 is thereby guaranteed in the transverse direction.

Figure 7:
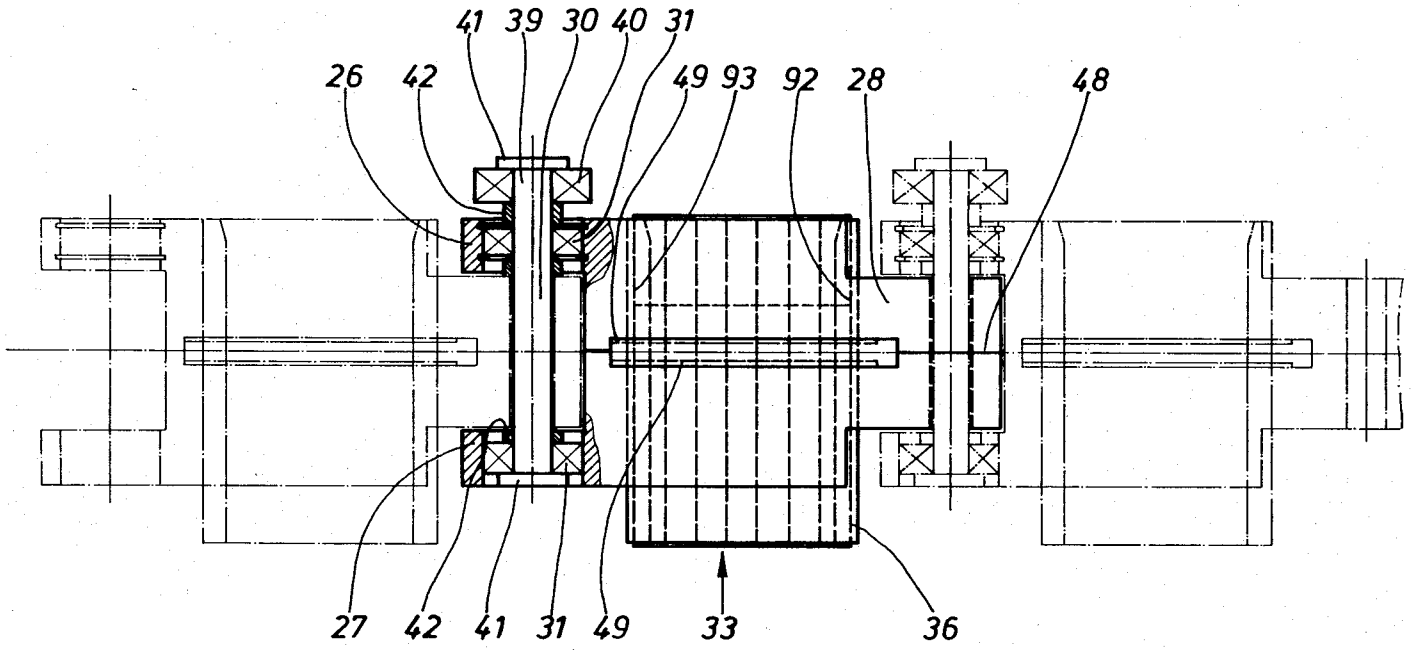
FIG. 7 shows a plan view relating to FIG. 6, partially in horizontal section.

Instead of two joint plates 26 . . . 29 which are offset or which are at a distance from one another, a single especfally wide joint plate 28 can be provided, as shown in FIG. 7.

The pockets 24 are also designed so that it is possible to guide the pocket conveyor 21 against lateral movement. For this purpose, elevations are provided on the top side (and, if appropriate, on the underside). In the exemplary embodiment of FIGS. 4 and 5, attached onto each pocket 24 is a toothed web 44. In the present exemplary embodiment, this is designed with flanks 45 in the form of an arc of a circle, and is fastened on a mounting pedestal 94 of the pocket 24 by means of a dovetail joint 46 in conjunction with anchoring bolts 47. The toothed web 44 appropriately consists of plastic.

Figure 6:
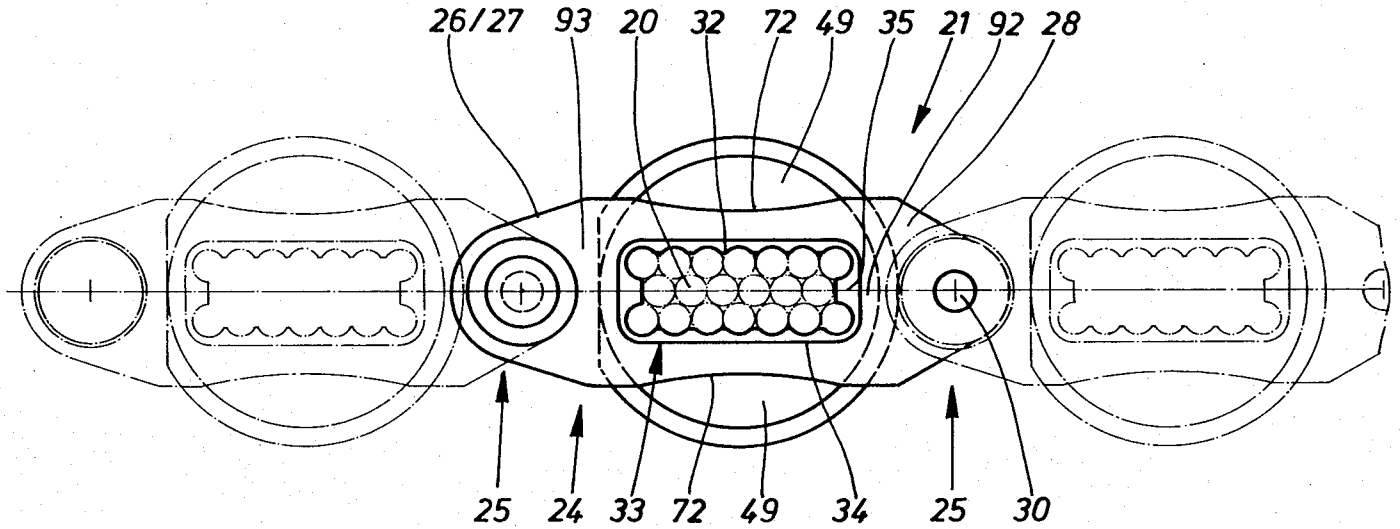
FIG. 6 shows another exemplary embodiment of a pocket conveyor, likewise in a diagrammatic side view.

In the exemplary embodiment of FIGS. 6 and 7, the pocket 24 is divided in the vertical longitudinal mid-plane, to form two pocket halves. In the region of a dividing plane 48, a toothed web 49 designed as a disc sits clamped in a corresponding recess. This toothed web 49 extends on the top side and underside of the pocket 24 and is made circular (with an orifice for forming the transversely continuous pocket orifice 32 or for the passage of the cassette 33). The pocket halves are held together by means of the pivot pins 30, which can be stressed in the longitudinal direction.

The pocket conveyor 21 designed in the way described is guided endlessly via deflecting rollers 50 and 51. This results in an upper strand 52 and a lower strand 53 of the pocket conveyor 21 with different movement characteristics.

In the preferred exemplary embodiment of FIG. 1, the insertion station 22 for the cigarette groups 20 is located in the region of the lower strand 53. This prevents fine tobacco, dust, etc. occurring in this region from penetrating into regions of the pocket conveyor 21 which are located underneath.

Figure 12:
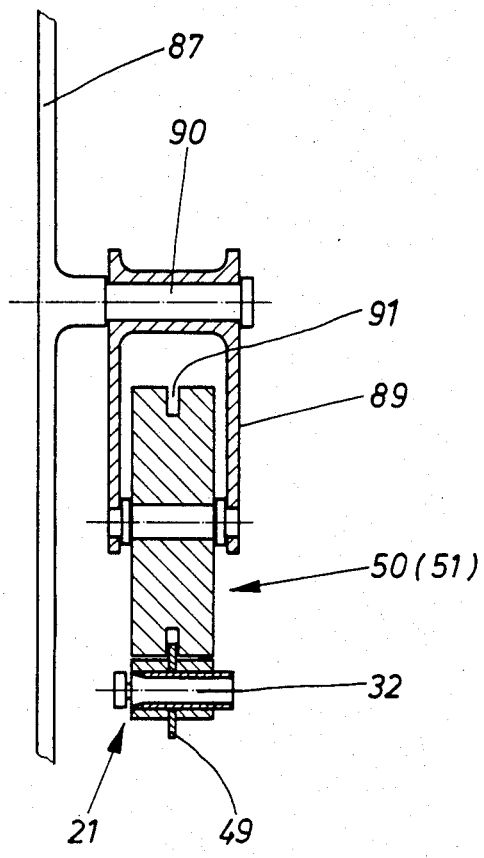
FIG. 12 shows, in radial section, a detail of the guide of the pocket conveyor, in particular a pressure roller.

In this exemplary embodiment, cigarettes are delivered to the insertion station 22 via a cigarette magazine 54. Here, the lower region of the cigarette magazine 54 consists of four outlet members, namely shaft groups 55, each intended for forming a cigarette group 20. The shaft groups 55 consist in the conventional way of vertical shafts which are divided off from one another by shaft walls and which are each intended for receiving a series of cigarettes arranged above one another. In the lower region, cigarette groups 20 are ejected by transversely directed slides 56 and are fed to the pocket conveyor 21 via a cigarette channel 57 (e.g. FIG. 12). Loosening members 58 de-signed and arranged in the conventional way are provided in the region of the cigarette magazine 54.

The shaft groups 55 each terminate with a lower ejection region exactly adjacent to an associated pocket 24 or pocket orifice 32. In this exemplary embodiment, four pockets 24 of the meanwhile stationary pocket conveyor 21 are consequently supplied simultaneously. After filling, the pocket conveyor 21 is moved further in the region of the lower strand 53 by an amount corresponding to four pockets 24, with the result that the next group of four pockets 24 assumes the supply position relative to the shaft groups 55.

The pockets 24 provided with cigarette groups 20 pass into the region of a first cigarette testing member 59 and then into the region of a second cigarette testing member 60. These serve for checking the cigarettes in the region of the ends of the latter (head check). The cigarette testing members 59, 60 are of a suitable known design.

Pockets 24 are then moved via the deflecting roller 50 into the region of the upper strand 52. This is driven continuously, that is to say moved uninterruptedly. The pocket conveyor 21 runs up against the periphery of the folding turret 23 in the region of the upper strand 52. In this region, the cigarette groups 20 are ejected from the pocket orifices 32 in the axial direction and delivered to members for wrapping them in an inner blank (tin foil blank).

The differing movement characteristics of the upper strand 52 (continuous movement) and lower strand 53 (intermittent movement) are obtained as a result of a to-and-fro movement of the deflecting rollers 50 and 51 in the horizontal plane. For this purpose, the deflecting rollers 50 and 51 are connected to one another by means of a rigid member, in particular a connecting rod 61. Via the latter, the movements of the deflecting rollers 50, 51 are controlled so as to ensure compensation of movement between the upper strand 52 and lower strand 53.

In the present case, the connecting rod 61 is moved by a cam mechanism 62 which consists of a three-armed angle lever 63, cam discs 64, 65 assigned to this and a transmission lever 66. The cam discs 64, 65 are made to rotate by a gear wheel 67 arranged centrally relative to the folding turret 23 and driven by the latter.

The pocket conveyor 21 can be brought up against the periphery of the folding turret 23 in various ways. In the advantageous exemplary embodiment of FIG. 1, the pocket conveyor 21 is brought up against the periphery of the folding turret 23 along a lower arc of a circle, specifically approximately along a quarter of the total periphery. Pressure rollers 68 and 69 are arranged respectively in the region of run-on onto the periphery and of run-off from the latter. In the exemplary embodiment of FIG. 1, these are located underneath the upper strand 52.

In the present case, the pocket conveyor 21 is driven by the folding turret 23. For this purpose, a turret disc 70, as part of the folding turret continuing in the axial direction, is provided with narrow groove-like depressions 71 along the periphery. These cause a kind of meshing of the turret disc 70. The likewise disc-shaped toothed webs 44 of the pockets 24 fit positively into the depressions 71 which, as slots in the form of a part circle, are arranged centrally along the periphery of the turret disc 70 at distances from one another corresponding to the pockets 24. The design of the depressions 71 also at the same time guarantees a certain lateral guidance and stabilization of the pocket conveyor 21 in this region. Outside the region of the depressions 71 and toothed webs 44, the pockets 24 are provided with concavities 72 in the form of an arc of a circle, only on the underside in the exemplary embodiment of FIGS. 4 and 5, but on the top side and under-side in the example of FIGS. 6 and 7. These concavities 72 fit up against the circular periphery or cylindrical surface of the turret disc 70.

During the time when the pockets 24 rest against the turret disc 70, the cigarette groups 20 are transferred to the folding-turret portions which are adjacent to the turret disc 70 in the axial direction and which are not shown in detail in the drawings.

In the design of the pocket conveyor 21 according to FIGS. 4 and 5 or 8 and 9, the concavities 72 in the form of an arc of a circle, formed on the inside of the pockets 4, are of such dimensions that the pockets 24 come positively up against the periphery or cylindrical surface of the deflecting rollers 50, 51 by means of this region, with the result that there is special guidance and alignment of the pockets 24 in this region.

Figure 2:
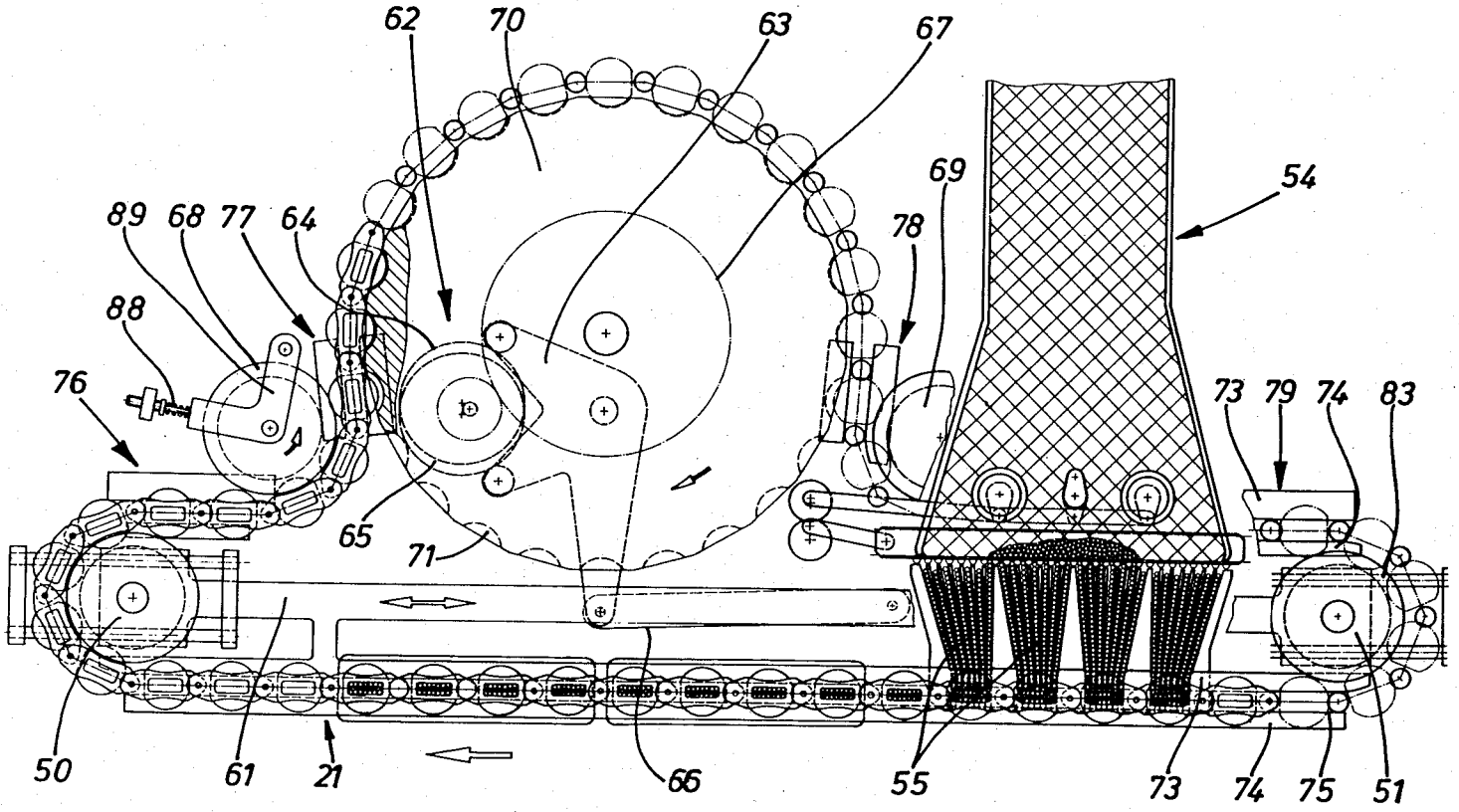
FIG. 2 shows a representation similar to that of FIG. 1, showing another exemplary embodiment of the apparatus.

In the exemplary embodiment of FIG. 2, the pocket conveyor 21 is guided on the top side of the folding turret 23 or turret disc 70 in the region of the upper strand 52. This produces a longer looping region, which can be more advantageous under appropriate operating conditions. In this solution, the pressure rollers 68, 69 are necessarily attached to the top side of the pocket conveyor 21.

Figure 3:
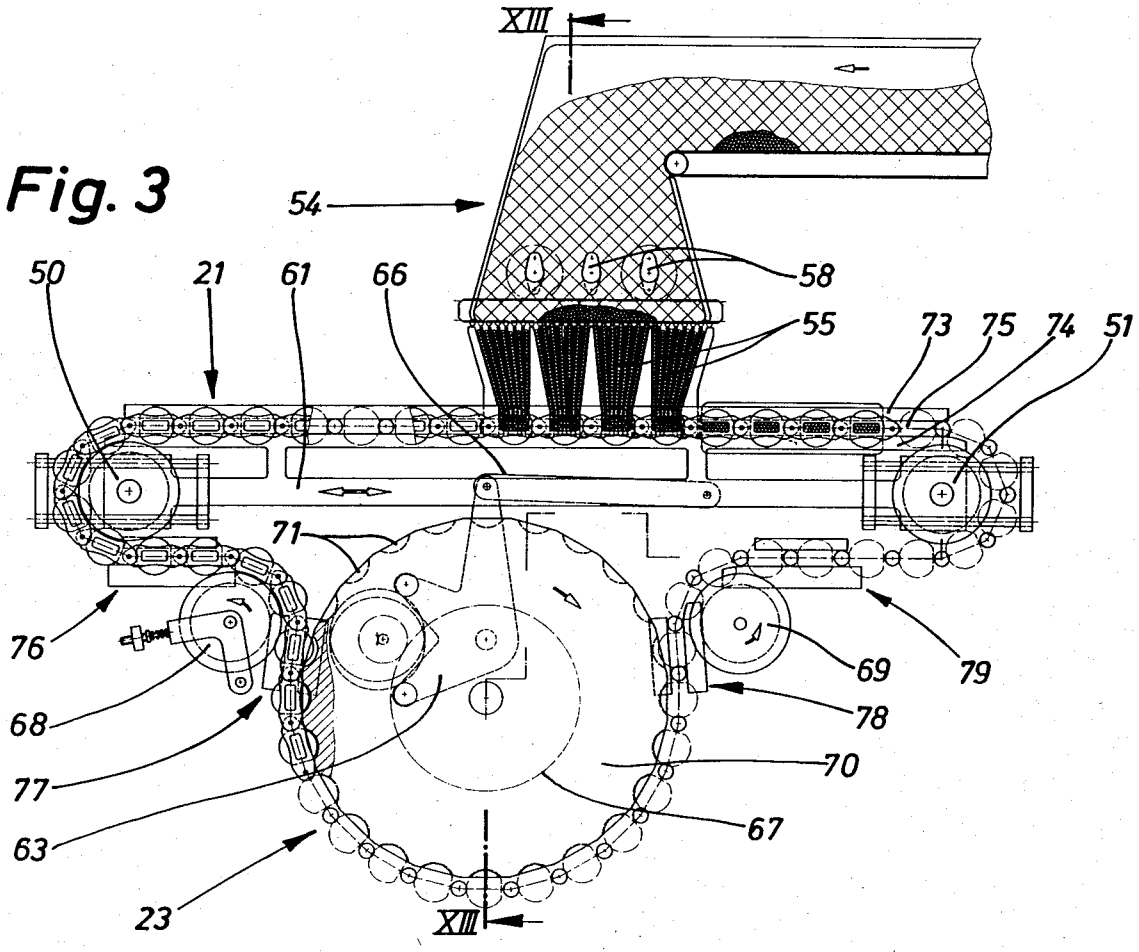
FIG. 3 shows a third exemplary embodiment in a representation corresponding to that of FIGS. 1 and 2.

FIG. 3 illustrates an alternative form, in that the cigarette magazine 54 is arranged in the region of the upper strand 52 and the folding turret 23 is arranged in the region of the lower strand 53. The movement characteristics of the upper strand 52 and lower strand 53 are modified accordingly.

Guides are assigned to the pocket conveyor 21 in selected regions, in order to prevent lateral movements and vertical movements, especially sagging. In the exemplary embodiments according to FIGS. 1 and 2, lateral guides in the form of an upper rail 73 and a lower rail 74 are arranged in the region of the lower strand 53 over the full length, namely between the deflecting rollers 50, 51. During the movement of the pockets 24 in the region of this upper rail 73 and lower rail 74, the lateral guide rollers 40 penetrate into the guide slot 75 formed between these. Guides 76, 77, 78 and 79 designed in a similar way are arranged in the region of upper strand 52. In the exemplary embodiment of FIG. 2, these guides are also provided in the region of run-on of the pocket conveyor 21 onto the periphery of the turret disc 70 and in the region of run-off from this. In the exemplary embodiment of FIG. 3, the guides described are arranged in a similar way. The guides can be formed on both sides of the pocket conveyor 21 (FIGS. 4 and 5) or only on one side (FIGS. 6 and 7).

Figure 8:
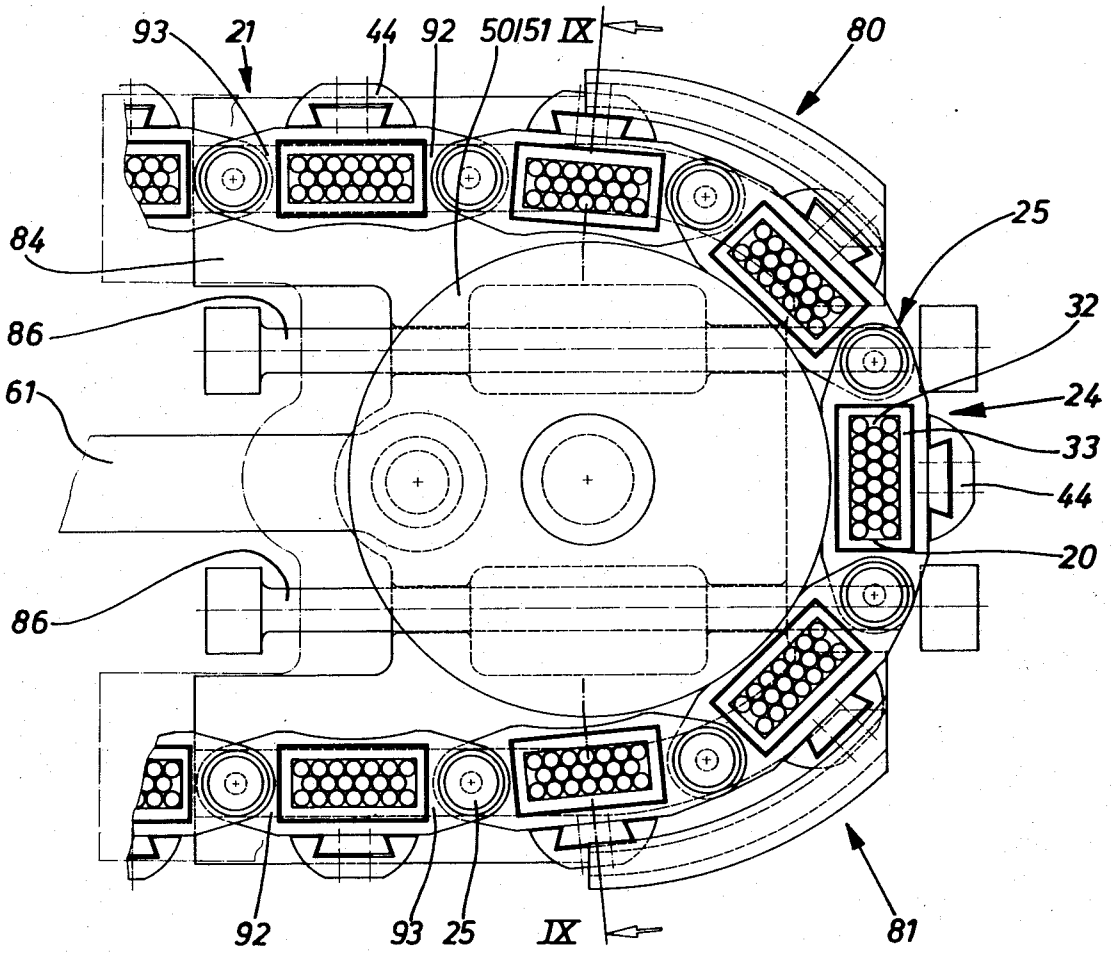
FIG. 8 shows a side view of a portion of the pocket conveyor in the region of a deflecting roller.
Figure 9:
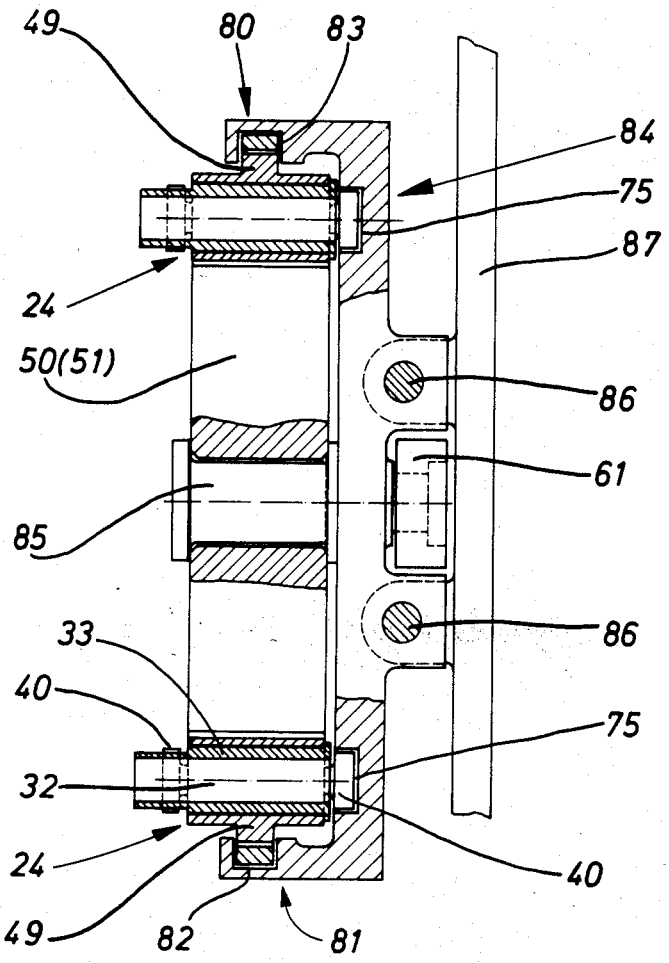
FIG. 9 shows a radial section of the detail according to FIG. 8 in the region of the deflecting roller.

Lateral movements are prevented, in individual regions of the path of movement of the pocket conveyor 21, by lateral guides 80, 81 which mainly extend in the region of deflection of the pocket conveyor 21 (FIG. 8). The lateral guides 80, 81 are likewise equipped with a guide slot 82, into which the toothed web 44 penetrates. In the exemplary embodiment of FIGS. 6 and 7 with toothed webs 49 extending on the top side and underside of the pockets 24, these toothed webs 49 penetrate, in the region of the deflecting rollers 50, 51, into corresponding roller slots 83, thereby likewise ensuring lateral guidance in this deflection region. As can be seen in FIG. 9, in this deflection region of the pocket conveyor 21, both lateral guide slots 75 and guide slots 82 assigned to the toothed webs 49 are formed in the region of a side cheek 84 movable to and fro together with the deflecting rollers 50, 51. A journal 85 for the deflecting roller 50, 51 is also mounted in this side cheek 84. The side cheek 84 is guided displaceably on sliding rods 86 of the machine frame 87.

Figure 10:
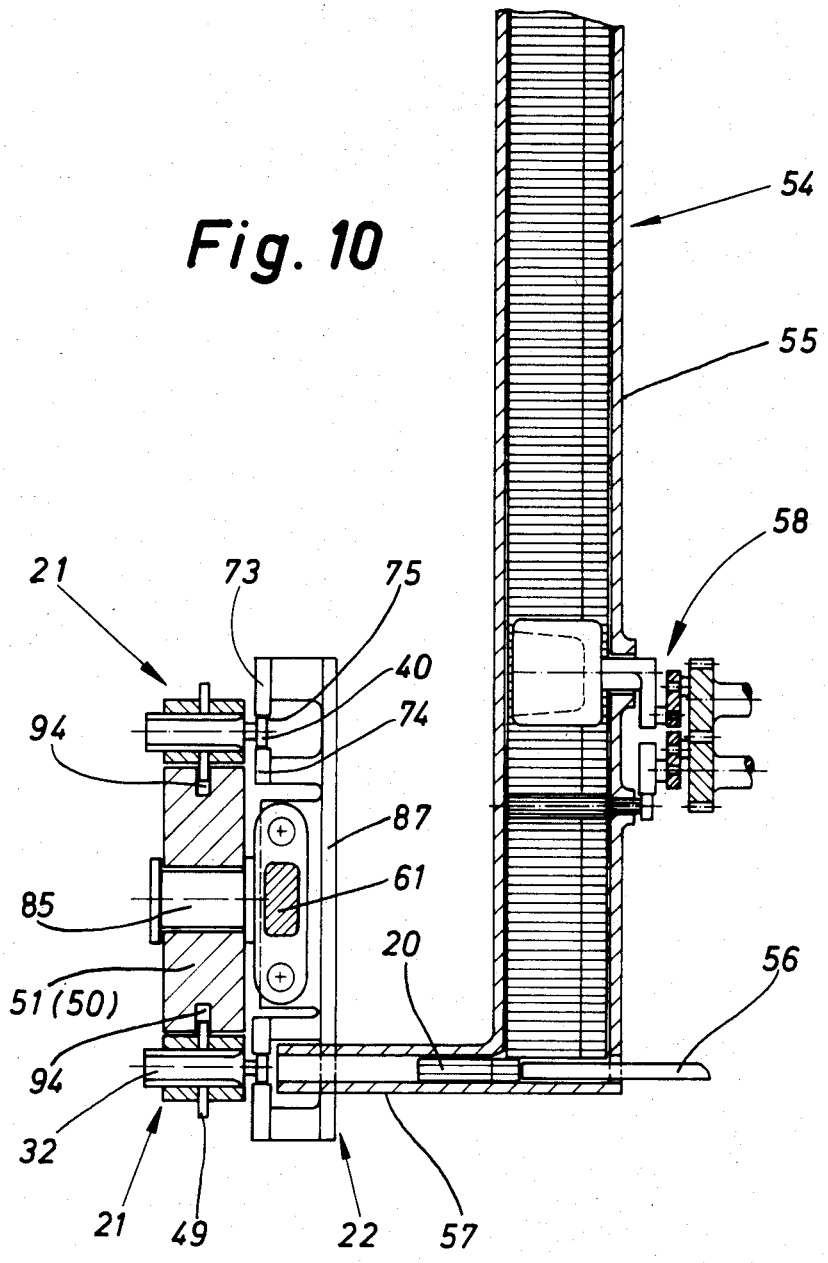
FIG. 10 shows a cross-section or vertical-section in the region of a station for inserting cigarette groups into the pocket conveyor.
Figure 11:
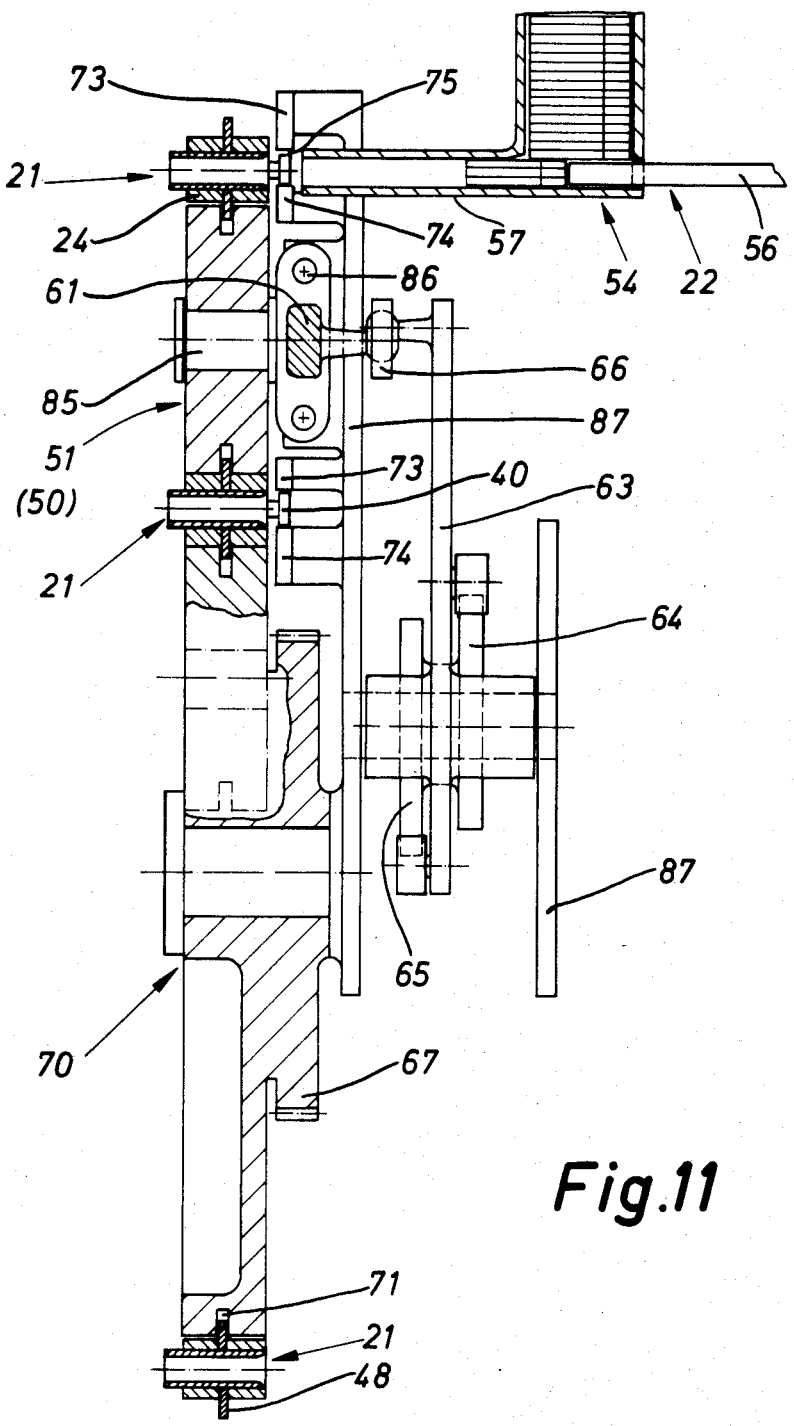
FIG. 11 shows an (offset) vertical or radial section in the region of the insertion station for cigarette groups, including the folding turret (of FIG. 3)

The pressure rollers 68, 69 are likewise designed so that, depending on the relative position, they have a slot for receiving the toothed webs 44. Moreover, the pressure rollers 68, 69 are mounted resiliently, in particular on an angular supporting arm 89 which is supported on a compression spring 88 and which is mounted on a supporting journal 90 fixed in place, that in connected to the machine frame 87. In the design of the pocket conveyor 21 according to FIGS. 6 and 7, that is to say with toothed webs 49 extending on both sides, the deflecting rollers 50, 51 are provided with a peripheral slot 91 which extends all round and into which the toothed web 49 penetrates in the region of deflection, as shown in FIGS. 1 to 3 and, for example, in FIG. 10.

I claim:

1. Apparatus for conveying cigarette groups in conjuction with a cigarette packaging machine, where each of the cigarette groups is received, in the direction of their lengths, in pockets of a driven endless pocket conveyor, characterized in that:

the pockets (24) are directly connected to one another by means of connector joints (25) designed to be free of play and free of wear;

the connector joints (25) comprise rolling bearings (31);

each pocket, on sides located oppositely to one another in the longitudinal conveying direction, is provided with respective pairs of first rigid joint plates (26, 27) and axially offset second rigid joint plates (28, 29) the first joint plates (26, 27) of a pocket being supported on common transverse pivot pin (30) with the second joint plates (28, 29) of an adjacent pocket; and the second joint plates (28, 29) of said adjacent pocket are fixed to said pivot pin (30), and the first joint plates (26, 27) of said each pocket are rotatably supported by said rolling bearings (31) on said pivot pin.

2. Device according to claim 1, characterized by the fact that the pockets (24) have circular arc-shaped concavities (72) on the under side which mate with a circular arc-shaped periphery of a holding turret (23).

3. Apparatus according to claim 1, characterized in that a pocket orifice (32) is arranged inside each pocket (24), as a recess open at the sides which has a closed cross-section and which is symmetrical relative to the longitudinal and transverse mid-plane of the pocket (24).

4. Apparatus according to claim 1, characterized by lateral guides (76 . . . 79) for the pockets (24), consisting of guide rollers (40) which are arranged at least at one end (39) of the pivot pin (30) and which periodically penetrate into fixed guide slots (74).

5. Apparatus according to claim 3, characterized in that the pocket orifices (32) are each formed by a cassette (33) which is inserted into a corresponding recess (34) in the pocket (24), the size of a pocket orifice (32) being determined by the shape and dimensions of cassette walls (35), the cassette having uniform external dimensions.

6. Apparatus according to claim 4, characterized by additional guidance of the pockets (24) against a lateral movement of the latter, by means of guide webs (44, 49) on the underside of the pockets (24), the guide webs penetrating periodically into fixed guide slots (82).

7. Apparatus according to claim 1, characterized in that the pockets (24) are provided on the underside with projections, which ensure meshing with the periphery of a folding turret (23).

8. Apparatus according to claim 7, characterized in that there are arranged on the under-side of the pockets (24) toothed webs (44, 49) with respectively upwardly and downwardly converging flanks which penetrate into depressions (71) matching these and arranged along the periphery of the folding turret (23).

9. Apparatus according to claim 8, characterized in that the toothed webs (44) consisting of plastic are attached onto the top side of the pockets (24), by means of a dovetail joint (46).

10. Apparatus according to claim 8, characterized in that the pockets (24) are divided in the longitudinal mid-plane, and a toothed web (49) extending above and below the pocket (24) is clamped, as a continuous circular disc, in the region of a central dividing plane (48).

11. Apparatus according to claim 8, characterized in that the drive for the pocket conveyor (21) is transmitted by the folding turret (23).

12. Apparatus according to claim 8, characterized in that the pocket conveyor (21) rests against the periphery of the folding turret (23) along a part circle, extending in the lower region of the folding turret (23) and of the size of approximately a quarter circle, the toothed webs (44, 49) at the same time engaging into the depressions (71) of the folding turret (23).

13. Apparatus according to claim 12, characterized in that the pocket conveyor (21) is pressed against the folding turret (23) by elastically mounted pressure rollers (68, 69), in the region of run-on to and run-off from the periphery of the folding turret (23).

14. Apparatus according to claim 8, characterized in that the endless pocket conveyor (21) guided via at least two deflecting rollers (50, 51) rests against the periphery of the folding turret (23) in the region of an upper strand (52).

15. Apparatus according to claim 14, characterized in that the deflecting rollers (50, 51) are provided with central peripheral slots (91) which are arranged along the periphery and into which the downwardly and inwardly directed toothed webs (49) penetrate.

16. Apparatus according to claim 1, characterized in that several pockets (24) of the pocket conveyor (21) are supplied, during the standstill of the latter, as a result of the simultaneous insertion of cigarette groups (20) in the region of a lower horizontal strand (53) of the pocket conveyor (21).

17. Apparatus according to claim 15, characterized in that the deflecting rollers (50, 51) of the pocket conveyor (21) arc movable to and fro simultaneously and together, in such a way that the pocket conveyor (21), whilst being driven continuously, stops temporarily in the remaining region of supply with cigarette groups (20), in the region of the lower strand (53).

18. Apparatus according to claim 17, characterized in that the deflecting rollers (50, 51) arc connected to one another by means of a rigid connecting rod (61) and arc driven to and fro by means of the folding turret (23) via a gear connected to the connecting rod (61).

* * * * *